United States Patent [19]

Van Meter

[11] Patent Number: 4,876,751

[45] Date of Patent: Oct. 31, 1989

[54] AUTOMATIC TOILET FLUSH CONTROL SYSTEM

[75] Inventor: Larry W. Van Meter, Louisville, Ky.

[73] Assignee: LineTech, Inc., Louisville, Ky.

[21] Appl. No.: 133,356

[22] Filed: Dec. 15, 1987

[51] Int. Cl.[4] ..... E03D 11/02; E03D 5/10

[52] U.S. Cl. ..... 4/431; 4/249; 4/DIG. 3

[58] Field of Search ..... 4/300, 302, 303, 304, 4/305, 313, 316, 431, 432, 433, 434, 435, 317, 318, 319, 420, 320, 421, 422, 423, 427, DIG. 3, 345, 249–251; 137/624.12, 624.11, 870

[56] References Cited

U.S. PATENT DOCUMENTS

| | | | |
|---|---|---|---|
| 3,334,358 | 8/1967 | McPherson | 4/420 |
| 3,334,359 | 8/1967 | Weingartner | 4/325 |
| 3,335,756 | 8/1967 | McPeherson | 137/628 |
| 3,566,415 | 2/1971 | Culp | 4/431 |
| 3,908,204 | 9/1975 | Hopkins | 4/249 |
| 3,994,628 | 11/1976 | Kemper | 417/307 |

*Primary Examiner*—Henry J. Recla
*Assistant Examiner*—J. Casimer Jacyna
*Attorney, Agent, or Firm*—F. H. Boos, Jr.

[57] ABSTRACT

An automatic flush control system is shown for a toilet of the type employing a first water flow to create a waste slurry in the toilet and a second water flow to cause the waste slurry to be pumped out of the toilet to a sewer connection. An interruptible timer is provided to set the duration of each water flow period. A sensor is provided responsive to an undesired condition of the supply water to interrupt and hold the timing count of the timer in place until the undesired condition is eliminated whereupon the interrupted water flow is continued for the remaining time on the interruptible timer without undesirable prolongation of the water flow period thus avoiding a flooding condition.

4 Claims, 3 Drawing Sheets

TIMING DIAGRAM

AUTOMATIC TOILET FLUSH CONTROL SYSTEM

BACKGROUND

This invention is directed to an automatic flush control system for a toilet. The invention has particular utility for use with an upflush toilet designed to flush waste water to a sewer line located above the waste outlet of the toilet although it is not limited to such a use as will be appreciated hereinafter.

A toilet of the upflush type is described in U.S. Pat. No. 3,334,358, issued Aug. 8, 1967 to H. W. McPherson. In the embodiment disclosed in connection with FIGS. 5 and 6 of this patent, a first water flow is directed for a period of time through an adapter near the base of the toilet to disintegrate and liquify the waste in the toilet. At the end of this time period a second water flow is directed through the adapter transverse to the outlet in the base of the toilet. This water serves to aid in pumping the waste water from the toilet to a sewer connection which can be located at an elevated level above the outlet of the toilet.

With a toilet of this type, the time period for the disintegration and liquifaction of the waste must be selected to be long enough to achieve the desired results but not so long as to cause overfilling of the toilet bowl and flooding of the surrounding area. This can accomplished manually by the user operating a valve control mechanism to switch from the liquifaction phase to the outflush phase at the appropriate time. However, it is desirable to make operation of the toilet automatic so that it is not necessary for the user to attend throughout the flushing operation. To this end a timing mechanism is conventionally provided that will cause the switchover to occur at a fixed preselected time in the process and will also terminate the flushout phase at the end of a fixed preselected time period. The time periods are normally determined by the manufacture to achieve the desired results under normal operating conditions. Provision is usually made to allow manual override by the user if desired or to avoid improper operation of the system. Such manual override is only effective if the user remains for the entire flushing operation which defeats some of the benefit of the automatic operation.

In a commercially available automatic flush valve of this type, the timing of switchover to the flushout phase is determined by equalization of pressure between two chambers of a slide valve, which equalization occurs by leakage of pressurized water from one chamber to the other through a small aperture provided for this purpose. While generally effective, the aperture can become clogged with buildup of minerals from the water which can have the effect of causing the initial liquifaction phase to be prolonged. If allowed to continue too long the toilet bowl can overfill during the liquifaction phase and cause flooding of the surrounding area. Correction of this problem can be an expensive and time consuming process usually requiring return of the valve unit to a repair facility during which time the toilet is out of service. Thus, in accordance with one aspect of the present invention it is desirable to provide an automatic control system for this purpose in which timing of at least the liquifaction phase is independent of conditions of the supply water. Additionally, and for similar reasons, it is desirable in accordance with another aspect of the invention that the duration of at least the liquifaction phase and preferably also the flushout phase be maintained relatively constant. If, for any reason, the particular operation is interrupted in the middle of the phase, it is highly desirable that provision be made to assure that re-initiation of the operation will not cause a complete recycling of the particular phase since it could cause overfilling if the liquifaction phase is involved and unnecessary waste of water if the flushout phase is involved.

It is therefore an object of the invention to provide an automatic flush system for a toilet of the general type described which is not adversely affected by conditions of the supply water.

It is a further object of the invention to provide an automatic flush system of the type described in which the active duration of either or both of the operating phases is maintained unchanged even if, for any reason, the operation of the phase is interrupted for any reasonable period of time.

SUMMARY OF THE INVENTION

Thus, in accordance with the present invention, there is provided an automatic flush control system for a toilet of the type employing a first water flow to disintegrate and liquify the waste contents in the toilet bowl and a second water flow to aid in pumping the liquified waste water from the bowl, which system comprises means for supplying input water from a pressurized supply line; first valve and controller means for initiating and maintaining the first water flow from the input water supply to the toilet for a first selected period of time required to disintegrate the waste in the toilet bowl; and second valve and controller means for initiating and maintaining the second water flow from the input water supply to the toilet for a second selected period of time required to pump out the waste water from the toilet bowl. The system of the invention further comprises interruptible timing means for determining the time duration of the first and second water flow time periods, the timing means having provision for retaining the time count in the event of temporary interruption such that restoring the timing action causes the timer to continue timing action from the point at which it was interrupted without prolonging the valve action beyond the selected time period. Finally, the system includes means responsive to an undesired condition of the input water supply for interrupting operation of the time until the undesired condition is eliminated.

The foregoing and other advantages will be apparent to those skilled in the art to which this invention pertains from a review of the following specification and the accompanying drawings, all of which are intended as exemplary only and are not to be taken as limiting the invention, the scope of which is defined by the appended claims.

DETAILED DESCRIPTION

Figure 1:
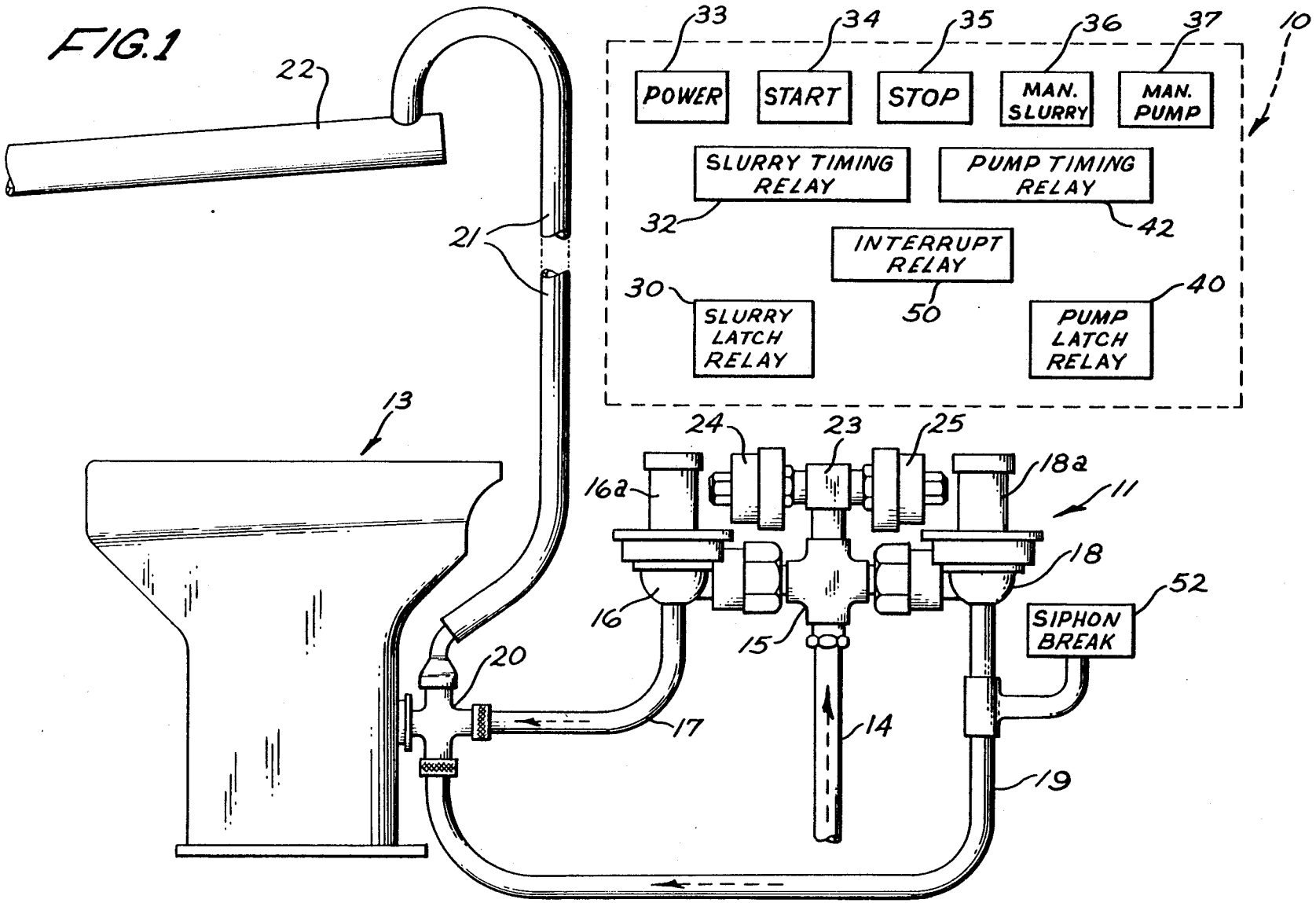
FIG. 1 is an illustration of the principal components of a preferred embodiment of the invention with a portion thereof being shown in block diagram form.

In FIG. 1, an automatic toilet flush control system comprises electric controls shown generally in the dotted box 10 and a solenoid operated valve and pressure sensor system shown generally at 11. A toilet 13, depicted as an upflush type of toilet, has its waste water outlet connected through a waste riser 21 to a sewer line 23 located at an elevation above the outlet of toilet 13.

Water used to clean and flush the toilet 13 is supplied under pressure from an input water supply line 14 to a junction 15. One outlet of junction 15 feeds a solenoid operated valve 16 which is employed to initiate and maintain a first water flow from supply line 14 via line 17 to an adapter 20. As explained more fully in the aforementioned U.S. Pat. No. 3,334,358, the water flow from line 17 is provided through adapter 20 as a high pressure jet of water which provides a swirling action in the bowl of toilet 13 to disintegrate and liquify the waste in the bowl and thus form a waste water slurry. Valve 16 is activated for a predetermined cycle time adequate to fully slurry the waste in the bowl.

At the conclusion of the slurry cycle, a second water flow of pressurized water from supply line 14 and junction 15 is provided via solenoid operated valve 18 and line 19 to another inlet of adapter 20 perpendicular to the slurry inlet. The water from line 19 forms a high pressure jet of water through adapter 20 directed up riser line 21 which serves to create a suction on the waste water in the bowl thus, in effect, pumping the waste water up the riser 21 to the sewer line 22. In conformance with most plumbing codes, a conventional siphon break 52 may be provided in line 19, for example, to prevent reverse flow of water from the toilet 13 or line 21 back into the water supply line 14.

Solenoid valves 16 and 18 are operated by slurry and pump latching relays 30 and 40, respectively, shown schematically in control system 10. Slurry timing relay 32 and pump timing relay 42 comprise timing means coupled to the solenoid valve **16*a* of slurry control valve 16 and solenoid valve 18*a* of pump control valve 18**, respectively, for setting the operative duration of each of the slurry and pump cycle time periods.

In accordance with one aspect of the invention, control means, including pressure sensor switches 24 and 25 and interrupt relay 50, are provided to be responsive to an undesired condition of the input water supply, such as a low pressure condition in supply line 14, to interrupt operation of the slurry and pump valves until the undesired condition is eliminated. For this purpose, input supply water is provided through another outlet of junction 15 and through a T-junction 23 to pressure sensor switches 24 and 25. Typically, pressure sensor switch 24 may be set to remain open until the input water pressure drops below 40 psi while sensor switch may be set to be open at pressures above 60 psi and to be closed when the water pressure drops below 60 psi.

Figure 2:
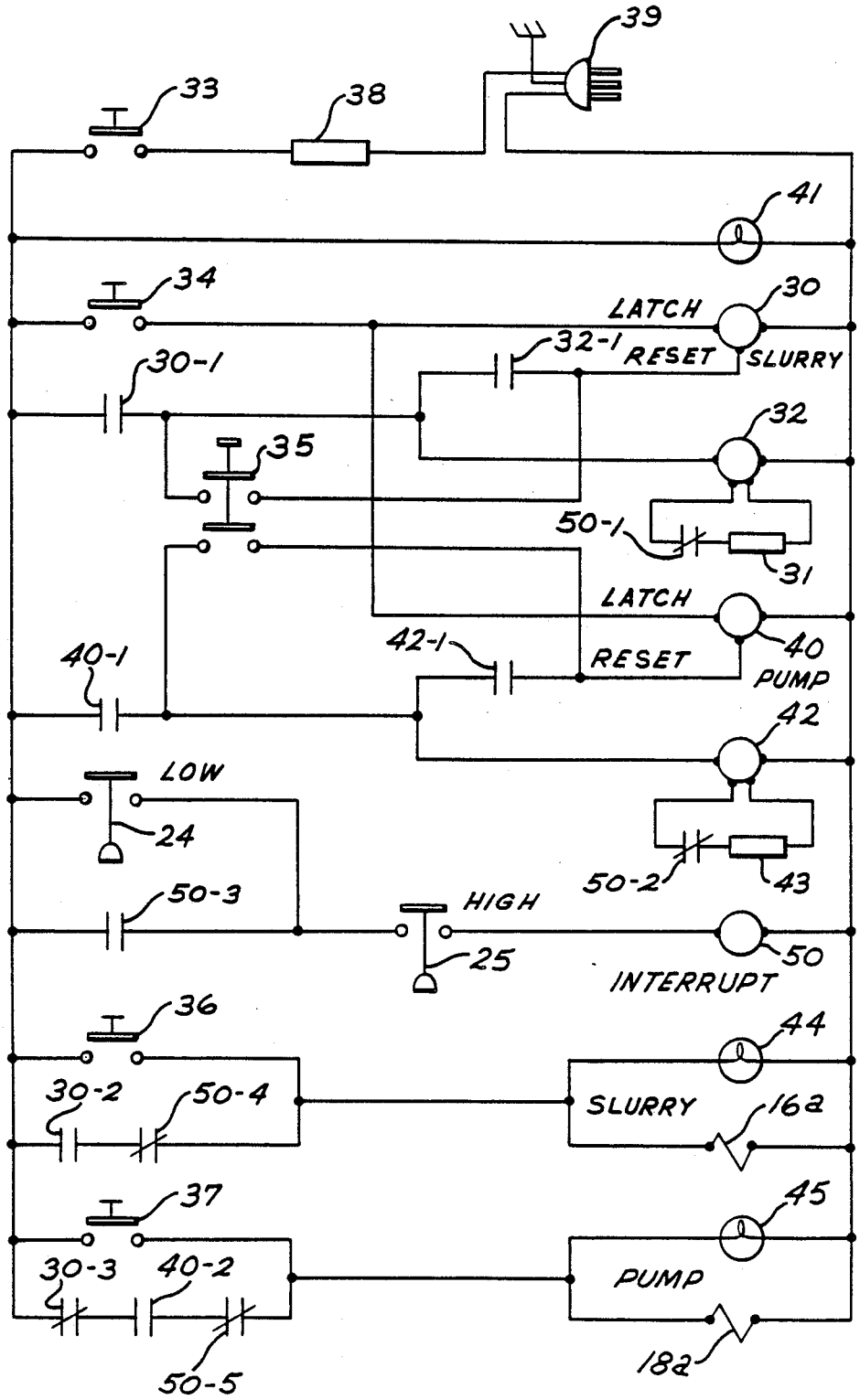
FIG. 2 is a schematic diagram of a control circuit used in the operation of the embodiment of FIG. 1.

As will be seen more clearly from the discussion of Fig. 2, and in accordance with another aspect of the invention, the timing means of the invention includes means responsive to the aforementioned interrupt control means for stopping and holding the timing count of the timing relays 32 and 42 in the event of an interruption of a slurry or pump operation so that, when water flow is restored to adapter 20, the remaining operative portion of the interrupted cycle can be completed without prolongation of the preset duration of the cycle. If, for example, the input water pressure dropped below 40 psi, the water jet into the bowl of toilet 13 would be unable to fully disintegrate and slurry the waste in the bowl and thus it is desirable to interrupt the cycle until the water pressure returns. However, when the cycle restarts, the slurrying water flow will add to the water previously remaining in the bowl and may cause to bowl to overfill and flood the surrounding area. Providing for holding the timing count of the timing relay 32 at the value it was at when the interruption occurred assures that only the remaining volume of water for the slurry operation will be provided to the toilet thus avoiding overflow conditions.

Figure 3:
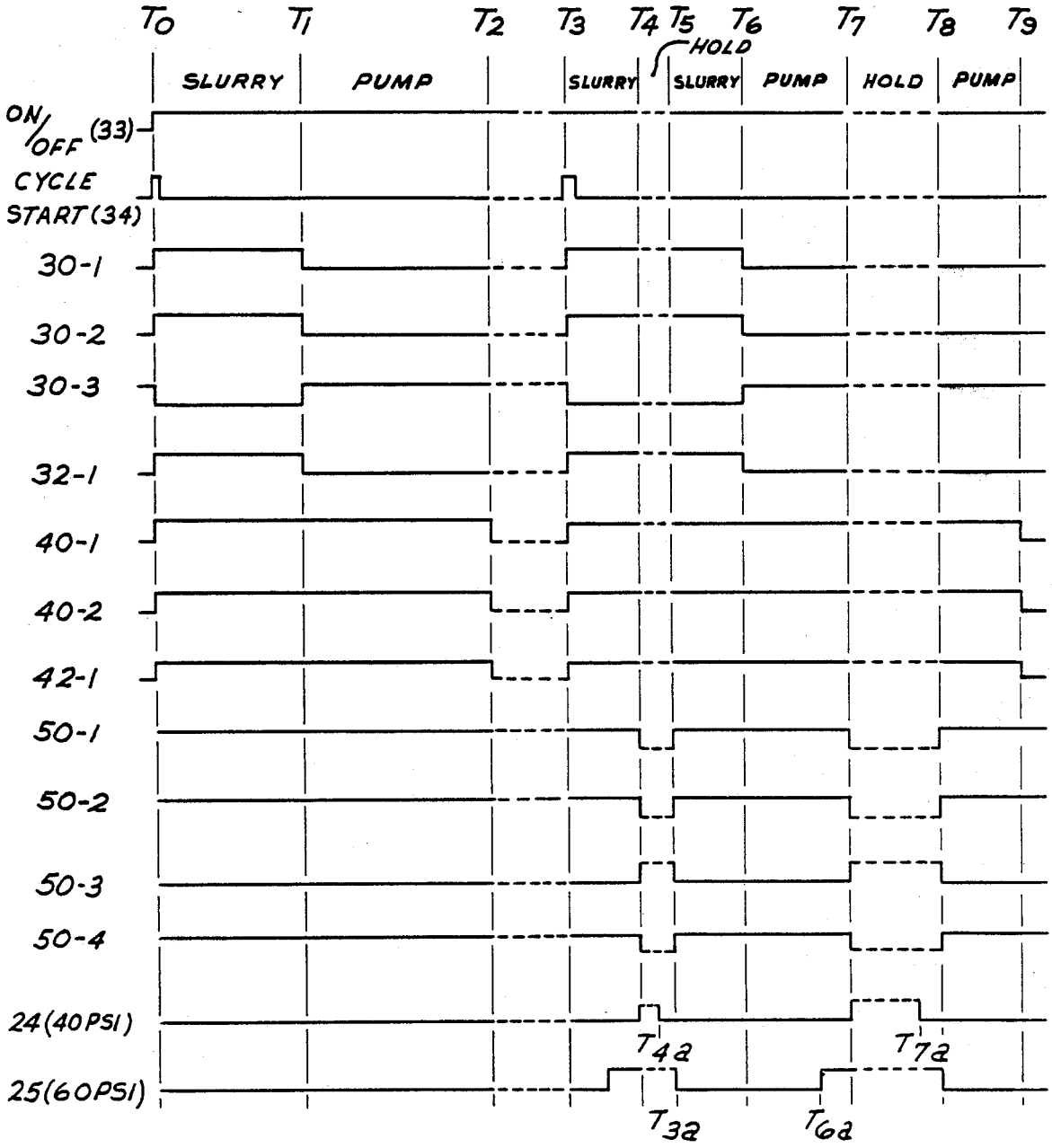
FIG. 3 is a timing diagram useful in explaining the operation of the circuit of FIG. 2.

Referring jointly to FIGS. 2 and 3 there is shown schematically a control circuit and an associated timing diagram that will be useful in understanding the structure and operation of the present invention. Thus, power is furnished via an input plug 39 through fuse 38 and an on/off toggle switch 33 to the remainder of the operating circuit of the automatic flush system with lamp 41 being provided to indicate when the system is in the "on" condition.

To start operation of the automatic flush system, momentary switch 34 is depressed by the user which applies power to activate, simultaneously, slurry latch relay 30 and pump latch relay 40. When activated, relay contacts 30-2 are closed and provide power through normally closed contacts 50-4 to slurry solenoid valve **16*a* and indicator lamp 44**. This commences the slurrying cycle as shown at time T0 in the timing diagram of FIG. 3.

At the same time, normally open relay contacts 30-1 and 40-1 are closed providing power to slurry timing relay 32 and pump timing relay 42. Relays 32 and 42 are conventional timing relays which become activated at the conclusion of a time period determined by a built-in R-C timing circuit which includes external resistors 31 and 43, respectively. As is well known, the value of the external resistance is selected to provide a predetermined cycle time period. Referring to FIG. 3, resistor 31 is chosen to provide an operative slurry cycle time period T0–T1, while a higher value is selected for external resistor 43 to provide a longer time period T0–T2 which encompasses the actual operative pump cycle time period T1–T2. When the timing count of timer relay 32 times out at time T1, contacts 32-1 close to reset slurry relay 30 thus opening contacts 30-2 and closing contacts 30-3. Since contacts 40-2 had been closed when pump latch relay was initially activated, power is now applied to pump solenoid 18a and indicator lamp 45 thus initiating the pump cycle time period at T1. When the timing count of timer relay 42 times out at time T2, timer contacts 42-1 close to reset pump relay 40. This opens contacts 40-2 and removes power from pump valve solenoid 18a, ending the pump cycle at time T2.

It will be appreciated from an inspection of the diagram of FIG. 3 that manual operation of the slurry and pump valves can be initiated by the user by depressing momentary switches 36 and 37, as desired. Also, automatic operation of the system can be terminated at any time by the user by depressing momentary switch 35 to apply power to the reset sides of relays 30 and 40.

Referring again to FIG. 3, the particular advantages of the present invention can be seen by an inspection of the right half of the timing diagram which illustrates operation of the system in the presence of an undesired condition of the input water supply, for example a low pressure condition which could cause improper operation of the slurrying and/or pumping action of the toilet.

Assuming the user depresses the momentary switch 34 at time T3 to initiate automatic operation of the system, the system commences operation in the same manner as previously described for time T0. If one assumes that up until now the water pressure in input line 14 has been higher than 60 psi, but drops at time T3*a* below that level, pressure sensor switch 25 closes. This has no effect on interrupt relay 50 since contacts 50-3 and pressure sensor switch are both open and thus the slurry cycle continues. Assuming however, the water pressure drops below 40 psi, as at time T4, sensor switch 24 then closes applying power to interrupt relay 50. This closes contacts 50-3 to latch relay 50 in the active condition. In accordance with an aspect of the invention, it also opens contacts 50-4 and 50-5 to remove power from slurry solenoid 16*a*. According to a further important aspect of the invention, it also opens contacts 50-1 and 50-2 which opens the R-C time constant circuits of timer relays 32 and 42. As is well known, opening a time constant circuit in this manner leaves the capacitor in the circuit with the existing charge. Except for negligible leakage current the capacitor will hold this charge for long periods of time. In this way, the timing circuit is stopped and the timing count, as represented by the charge on the capacitor, is held until such time as the R-C circuit is again completed by closing contacts 50-1 and 50-2.

Assuming the input water rises above 40 psi. at time T4*a*, sensor switch 24 opens but interrupt relay 50 remains activated through sensor switch 25 and contacts 50-3. This is to assure that a marginal rise in water pressure does not cause an oscillating condition to occur in the system. Once the pressure rises to 60 psi at time T5, switch 25 opens and interrupt relay 50 is then reset to its normal condition which closes contacts 50-4 and 50-5 to reactivate slurry solenoid 16*a* and pump solenoid 18*a*, respectively.

The operation of the system for time period T6–T9 is the same as just described and the description need not be repeated. It will be noted however, that the total operative slurry time period comprised of periods T3–T4 and T5–T6 is equal to the duration of the slurry time period T0–T1 irrespective of the duration of the intervening hold period T4–T5. Similarly, the total operative pump time period comprised of periods T6–T7 and T8–T9 is the same as the duration of the pump time period T1–T2 irrespective of the duration of the intervening hold period T7–T8.

It will be appreciated that by interrupting the timing circuit and holding the timing count when an undesirable condition occurs, such as a drop in input water pressure, the flushing action of the toilet is allowed to continue as though no adverse condition had occurred and improper operation that could cause flooding is avoided. Moreover, because the timing operation is performed by an electrical circuit independent of reliance on water pressure or other water conditions, such as mineral content that could adversely affect pressure differential valves, a more reliable flushing operation is achieved.

It will be appreciated by those skilled in the art that the use of an RC time constant circuit as the timing means is but exemplary of the means by which interruptible timing can be accomplished and that other means may be employed with equal benefit. For example, digital timing circuits are well known in which timing is measured by digital numerical count and such circuits can be substituted within the spirit and scope of this invention.

Various other modifications may suggest themselves to those skilled in the art without departing from the spirit of the invention, and, hence, the invention is not intended to be restricted to the specific embodiments illustrated or described herein except as indicated by the appended claims.

What is claimed is:

1. An automatic flush control system for a toilet of the type employing a first water flow to slurry the waste contents in the toilet bowl and a second water flow to pump the waste water slurry from the bowl, the system comprising:

means for supplying input water from a pressurized supply line;

first solenoid operated valve means for initiating and maintaining the first water flow from the input water supply to the toilet for a predetermined slurry cycle time period as required to slurry the waste in the toilet bowl;

second solenoid operated valve means for initiating and maintaining the second water flow from the input water supply to the toilet for a predetermined pump cycle time period as required to pump out the waste water slurry from the toilet bowl;

control means responsive to a decrease in pressure of the input water supply for interrupting operation of the first and second valve means until the decrease in pressure is eliminated;

timing means providing a timing count coupled to the first and second valve means for setting the duration of each of said slurry and pump cycle time periods, said timing means including means responsive to the control means for stopping and holding the timing count in the event of an interruption of one of said cycles and for resuming said timing count when said pressure is restored, whereby the cycle can be completed without prolongation of the predetermined duration thereof.

2. The automatic flush control system of claim 1 in which the means comprises slurry and pump cycle timers jointly responsive to said interrupting control means such that interruption of the slurry cycle also causes the timer for the pump cycle to stop and hold its timing count until the slurry resumes operation.

3. The automatic flush control system of claims 1 or 2 in which the control means includes a first pressure sensor switch responsive to a low water pressure condition of the water supply to interrupt the timing means and the flow of water by the valve means to the toilet until the water pressure returns to a desired level.

4. The automatic flush control system of claim 3 in which the control means includes a second pressure sensor switch to maintain the timing means and the valve means in the interrupted condition until the water supply pressure rises to a predetermined level higher than the low pressure level that caused the interruption.

* * * * *